United States Patent [19]

Kumano

[11] Patent Number: 4,510,839

[45] Date of Patent: Apr. 16, 1985

[54] KEYBOARD STRUCTURES OF ELECTRONIC MUSICAL INSTRUMENTS

[75] Inventor: Shinji Kumano, Shizuoka, Japan

[73] Assignee: Nippon Gakki Seizo Kabushiki Kaisha, Hamamatsu, Japan

[21] Appl. No.: 334,288

[22] Filed: Dec. 24, 1981

[30] Foreign Application Priority Data

Dec. 25, 1980 [JP] Japan ..... 55-184464

[51] Int. Cl.[3] ..... G10C 3/12

[52] U.S. Cl. ..... 84/434; 84/439

[58] Field of Search ..... 84/433–436, 84/439–440, 423

[56] References Cited

U.S. PATENT DOCUMENTS

| | | | |
|---|---|---|---|
| 721,706 | 3/1903 | Huseby | 84/434 |
| 1,840,712 | 1/1932 | Grant | 84/433 X |
| 2,228,141 | 1/1941 | Magnante | 84/440 X |
| 2,612,812 | 10/1952 | Greenleaf et al. | 84/423 X |
| 3,026,760 | 3/1962 | Fauser | 84/440 X |
| 3,499,971 | 3/1970 | Ohno | 84/436 X |
| 3,654,831 | 4/1972 | Grilli et al. | 84/435 |
| 3,663,738 | 5/1972 | Nakada | 84/423 |
| 3,835,235 | 9/1974 | Amano | 84/433 X |
| 3,935,784 | 2/1976 | Koepke | 84/435 |

*Primary Examiner*—Lawrence R. Franklin

*Attorney, Agent, or Firm*—Remy J. VanOphem

[57] ABSTRACT

A keyboard of an electronic musical instrument is constituted by a plurality of keys and a keyboard frame. The keys are juxtaposed on the keyboard frame to be tiltable in the vertical direction. Between each key and the keyboard frame, there are provided a key return spring, a key return spring engaging member and an upper limit stop member for each key. The key return spring engaging member is fitted to either one of the keyboard frame and each key. One end of the key return spring engages the key return spring engaging member, while the other end engages either one of the each key and the keyboard frame. The upper limit stop member is disposed adjacently to key return spring and limits a returning tilting motion of each key caused by the key return spring. This adjacent disposition of key return spring and the upper limit stop member prevents bending of the keyboard frame and also makes it easy to adjust the touch and the alignment of the keys.

14 Claims, 13 Drawing Figures

KEYBOARD STRUCTURES OF ELECTRONIC MUSICAL INSTRUMENTS

BACKGROUND OF THE INVENTION

The present invention relates to a keyboard structure of an electronic musical instrument.

In an electronic musical instrument having a keyboard, it is essential to cause a key touch to have a desired characteristic which is preferable for players. Various structures have been proposed to obtain the desired characteristic and various improvements thereof have been made.

In a typical prior art construction, a key return spring member is provided at the rearward end of each key and an L-shaped stopping member is provided near the forward end of the key to engage a keyboard frame disposed beneath the key for limiting the upward rotation of the key. With such construction, a troublesome operation is required for adjusting the key touch. More particularly, the key touch adjusting operation includes the alignment of the height of a plurality of juxtaposed keys, and the adjustments of depression key touches and release key touches of respective keys to have uniform characteristics. In the prior art construction, however, the position of the returning spring member and the position at which the upper limit stopping member engages the frame are spaced considerably in the longitudinal direction of each key, so that after one of the members of one key is adjusted, it is necessary to depress the key to check the key touch and then adjust the remaining member or to adjust the one member once more.

Due to the large space described above between the return spring member and the upper limit stopping members, an adjuster must extend his hand different distances for adjusting respective members, which results in a different feeling of adjustment as well as a long time for effecting this fine and delicate key touch adjustment. Furthermore, in the key construction described above, the returning spring member applies a downward force at the rearward end of each key, while the upper limit stopping member applies an upward force to the frame at the forward end of the key. As a consequence, the strain acting in the vertical direction of the frame increases toward its center. In other words, the strain of the frame is greatest at its longitudinal center of the key array, thus bending or distorting the keyboard.

SUMMARY OF THE INVENTION

Accordingly, it is an object of the present invention to provide an improved keyboard structure for an electronic musical instrument capable of more readily adjusting the key touch than prior art keyboard structures.

Another object of the present invention is to provide a keyboard structure of an electronic musical instrument capable of decreasing strain or bending of the keyboard, as compared with prior art keyboard structures.

A keyboard structure for an electronic musical instrument, according to the present invention, includes a keyboard frame and a plurality of keys juxtaposed on the keyboard frame to be tiltable in the vertical direction. A key return spring is provided for each key, each key return spring being disposed between each one of the keys and the keyboard frame. A key return spring engaging member is provided for each key. One end of the key return springs engages the key return spring engaging member, while the other end engages either one of the keys or the keyboard frame. An upper limit stop member is provided for limiting a returning tilting motion of each key. The key return spring and the upper limit stop member for each key are disposed closely together in order to prevent bending or distorting of the keyboard frame.

BRIEF DESCRIPTION OF THE DRAWINGS

In the accompanying drawings:

FIGS. 10(*c*) and 10(*d*) are sectional views of the stop block taken along lines X*c*–X*c* and X*d*–X*d*, respectively, of FIG. 10(*a*).

DETAILED DESCRIPTION OF THE PREFERRED EMBODIMENTS

Figure 1:
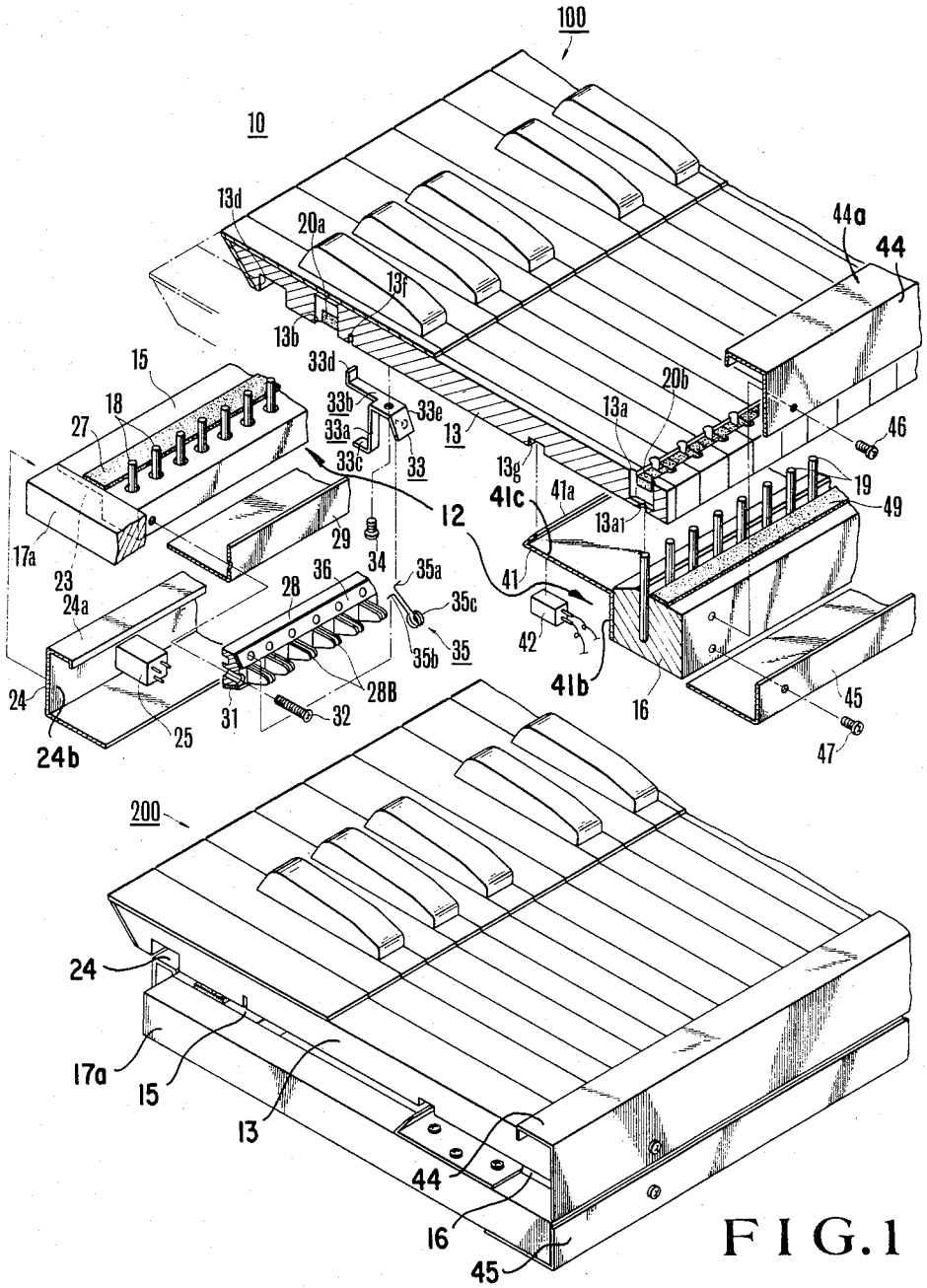
FIG. 1 is an exploded perspective view of one embodiment of a keyboard structure of an electronic musical instrument according to the present invention.
Figure 2:
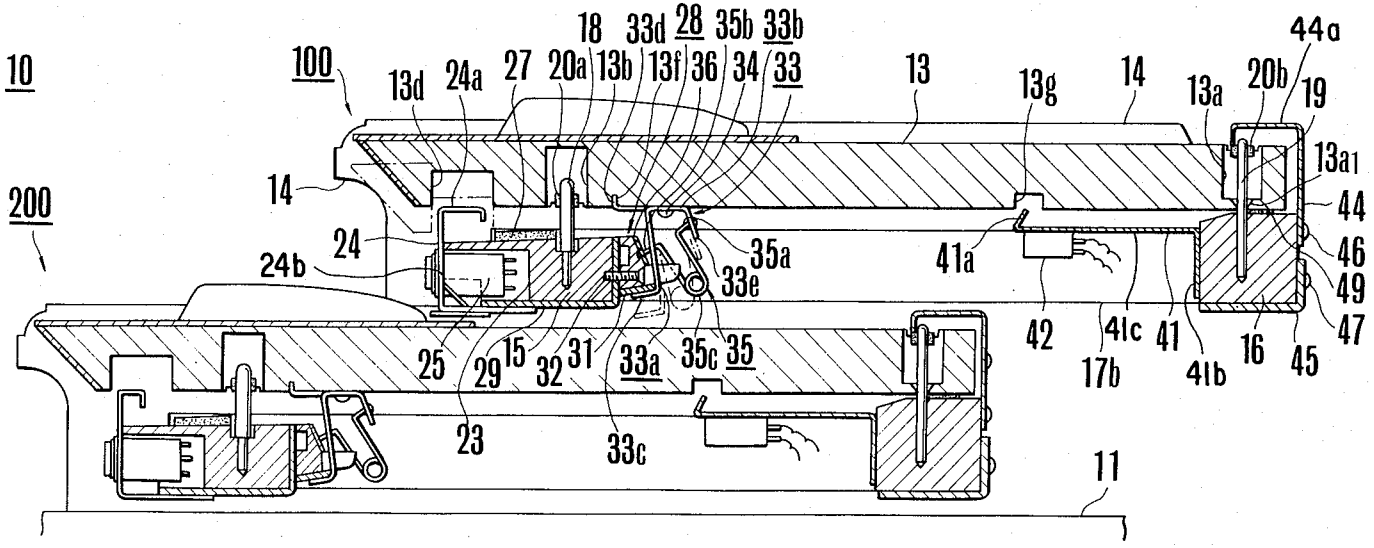
FIG. 2 is a longitudinal sectional view of certain portions of the keyboard structure shown in FIG. 1.
Figure 3:
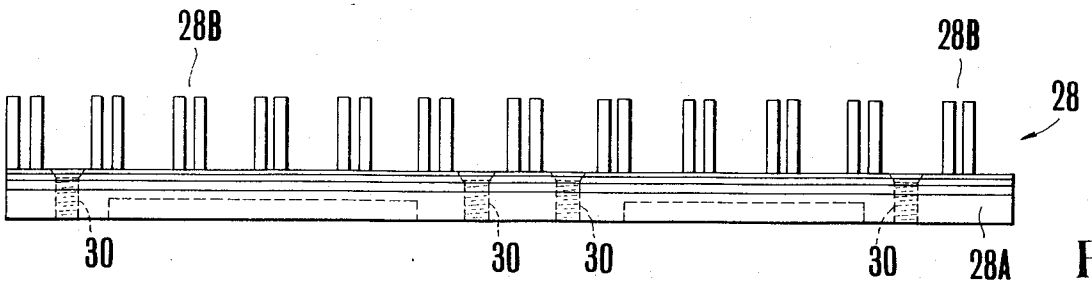
FIG. 3 is a plan view showing a stop block member shown in FIG. 1.

FIGS. 1, 2 and 3 show a keyboard structure 10, and component parts thereof, of an electronic musical instrument according to the present invention which includes a pair of keyboard assemblies 100 and 200 disposed above a panel board 11 (see FIG. 2) of the musical instrument. In this embodiment, since both of the keyboard assemblies 100 and 200 have the same construction, only the keyboard assembly 100 will be described in detail.

The keyboard assembly 100 is provided with a plurality of keys 13 in a combination of white and black keys well known in the art, juxtaposed on a keyboard frame 12, as best shown in FIG. 1.

The keyboard frame 12 takes the form of a rectangular frame opened at its center and extending in the direction of the array of the keys 13. Transverse connecting members 17*a*, shown in FIG. 1, and 17*b*, shown at FIG. 2, of the frame 12 are firmly secured to the inner side surfaces of end blocks 14, shown in FIG. 2, by set screws or the like. The keyboard frame 12 includes a front rail 15 and a rear rail 16 made of wood or the like and arranged, respectively, at the forward and rearward ends of the keyboard frame 12 to extend along the entire array of the keys 13. The front rail 15 and the rear rail 16 are interconnected by the transverse connecting members 17*a* and 17*b*, which constitute the opposite ends of the keyboard frame 12. A front pin 18 and a balance pin 19 for each key 13 are secured to the upper surfaces of the front rail 15 and the rear rail 16, respectively.

Each key 13 has a touch similar to that of a key of a conventional piano. The upper end of the balance pin 19 corresponding to each key 13 is generally received in an elongated slot 13*a*. More particularly, the balance pin 19 is passed through a funnel shaped opening 13*a*1, disposed at the bottom of the slot 13*a* and having a diameter smaller than the width of the slot 13*a* so that the key 13 can swing or tilt in the vertical direction about the bottom opening 13*a*1. A felt layer 49 is interposed between the inner surface of the slot 13*a* and the balance pin 19 for preventing the jolting of the key and the generation of noise. The lateral movement of each key 13 is prevented by inserting the upper end of the front pin 18 associated therewith into a recess 13*b* formed on the lower surface of the key. A felt layer 20*a* is interposed between the inner surface of the recess 13*b* and the front pin 18 to support and balance the front pin 18 and for further preventing the jolting of the key and the generation of noise. A felt layer 20*b* is interposed between the upper surface of the recess 13*a* and the balance pin 19 for a similar purpose.

A recess 23, shown in FIG. 2, is formed at the front surface of the front rail 15 for mounting a switch 25. A C-shaped front cover 24 closes the opening of the recess 23 to support the switch 25. The C-shaped front cover 24 includes a vertical portion 24*b* which extends upwardly towards the lower surface of the key 13 and is bent backwardly at a right angle to form a horizontal portion 24*a*. The lower surface of the forward end of the key 13 is formed with a recess 13*d* corresponding to the horizontal portion 24*a* of the front cover 24, thus permitting downward tilting of the key 13. When depressed, the key 13 is rotated downwardly about its rear end until stopped by a cushion member 27, made of felt or a similar material, mounted to the front rail 15.

To the rear surface of the front rail 15 are secured a plurality of stop blocks 28 at a predetermined spacing by a single elongated L-shaped fitting 29 made of metal. Each stop block 28 is made of a synthetic resin, for example, an acrylonitrile-butadiene-styrene (ABS) resin. One stop block 28 is provided for each octave, as shown in FIG. 3. Each stop block 28 has a substantially trapezoidally shaped main body 28A having a length covering one octave of keys and a total of twelve sets of rearwardly directed projections 28B, each of the sets corresponding to one of the twelve keys of the octave. A plurality of screw threaded openings 30 are provided through the main body 28A as shown in FIG. 3. A layer of cloth, or other similar cushion material 31, is secured to the lower surface of the main body 28A along the entire length thereof. The stop block 28 and the layer of cushion material 31 cooperate with an upper limit stop member in a manner to be described later herein. Each stop block 28 is firmly secured to the front rail 15 together with the L-shaped fitting 29, by set screws 32 shown in FIG. 2, threaded into suitable threaded openings of the L-shaped fitting 29 and the front rail 15 and through the openings 30 of the main body 28A.

A key return spring engaging member 33 is secured to the lower surface of each key 13 near its forward end by a screw 34 at a position corresponding to each stop block 28. Each key return spring engaging member 33 is formed by bending a metal strip into a T shape having a vertical piece 33*a*, and a horizontal piece 33*b* parallel with the lower surface of the key 13. The vertical piece 33*a* extends towards the lower side of the stop block 28 through a space between the projection 28B of the stop block 28 corresponding to a given key 13 and another projection 28B adjacent the corresponding projection 28B. The lower end of the vertical plate 33*a* is bent ninety degrees (90°) toward the forward end of the key 13 to form an engaging portion 33*c* adapted to engage the lower side of the layer of cushion material 31, thus forming the upper limit stop member for the key 13. The forward end 33*d* of the horizontal piece 33*b* is bent upwardly to engage a groove 13*f* formed on the lower surface of the key 13. The rearward end 33*e* of the horizontal piece 33*b* is bent downwardly at a predetermined angle to form a spring engaging member.

One end 35*a* of a key return spring 35, in the form of a coil spring, engages the spring engaging member 33. The other end 35*b* of the key return spring 35 engages a fixture 36 secured to the rear side of the stop block 28. One end 35*a* of the key return spring 35 is depressed downwardly by the weight of the key 13. A spring force tending to separate the opposite ends 35*a* and 35*b* of the coil spring 35*c* is created to provide the key 13 with restoring force tending to rotate the key in the clockwise direction, as viewed in FIG. 2. Thus, the bent engaging portion 33*c* of the vertical piece 33*a*, constituting the upper limit stopping member, is caused to engage the layer of cushion material 31 to limit the rotation of the key 13 in the upward direction, thus maintaining the key 13 at a substantially horizontal initial position.

The depression stroke of the key 13 is adjusted by varying the bending angle of the bent engaging portion 33*c*. The key touch feeling is adjusted by varying the spring force of the key return spring 35 for the key 13 by varying the bending angle of the rearward portion 33*e* of the key return spring engaging member 33. The other end 35*b* of the key return spring 35 is inserted between projections 28B of the stop block 28 corresponding to a given key return spring 35 to prevent leftward or rightward tilting of the key return spring 35 about either one of the ends 35*a* and 35*b* of the return spring.

An L-shaped key switch frame 41 has a vertical portion 41*b* secured to the forward surface of the rear rail 16 by screws or the like, not shown, and a horizontal portion 41*c* extending forward therefrom. Key switches 42 corresponding to respective keys 13 are secured to the lower surface of the horizontal portion 41*c* of the key switch frame 41. An angularly bent up portion 41*a* of the horizontal portion 41*c* of the frame 41 enters into grooves 13*g* provided for the lower surfaces of the keys 13 when the keys are depressed. Each key switch 42 is constructed to be actuated by a depressed key 13 or an actuator, not shown, integral with the key.

An inverted L-shaped key end cover 44 and a reinforcing fixture 45 are secured to the rearward surface of the rear rail 16 by screws 46 and 47, respectively. The upper portion 44*a* of the key cover 44 extends horizontally above the rearward ends of the keys 13 and is then bent downwardly to engage, with a slight force, with the felt layer 20*b* provided for the rear upper surfaces of the keys 13 to prevent them from disengaging from the balance pins 19. A layer of cloth 49 is interposed between the keys 13 and the rear rail 16.

According to the keyboard structure 10 described above, the upper limit stop member 33*c* and the key return spring 35 are located closely so as to adjust the key stroke and the key touch feeling at adjacent portions. Therefore, the adjustments can be made readily.

Furthermore, external forces acting upon the keyboard frame 12 are concentrated approximately at a single portion and act in the opposite directions, thereby greatly reducing the total force acting upon the keyboard frame 12. As a consequence, the keyboard frame 12 would not be flexible and, therefore, the strength and the cost of the frame 12 can be greatly reduced. Moreover, as the upper limit stop member 33*c* is integrally formed with the key return spring engaging member 33, it is possible to reduce the number of component parts, thus, facilitating an assembling operation. Moreover, as the upper limit stop member 33*c* and the key return spring 35 are disposed on the lower surface of the front end of each key 13, the adjustments of the key stroke and key touch feeling become easier.

Figure 4:
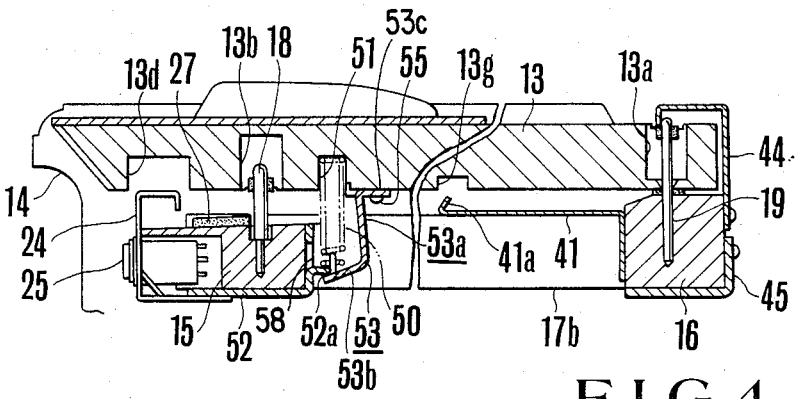
FIG. 4 is a sectional view, partially broken away, showing a second embodiment of the present invention.

FIG. 4 shows the second embodiment of the present invention in which component elements identical to those shown in FIGS. 1, 2 and 3 are designated by the same reference numerals. In this embodiment, a compression coil spring 50 is used as the key return spring. The upper end of the coil spring 50 is received in a recess 51 formed on the lower surface of each key 13. The lower end of the coil spring 50 receives an upright pin 58 formed near the lower end 52*a* of the key return spring engaging member 52 secured to the lower surface of the front rail 15. An upper limit stop member 53 of the key return spring engaging member 52 is secured independently to the lower surface of the key 13 at a position close to the recess 51 which receives the upper end of the spring 50. The upper limit stop member 53 is formed by bending a single metal strip into an L-shaped member having a vertical portion 53*a* and horizontal portions 53*b* and 53*c*. The lefthand end of the horizontal portion 53*b* is urged against the lower end 52*c* of the key return spring engaging member 52. By changing the bending angle of the horizontal portion 53*b*, it becomes possible to simultaneously adjust the key touch feeling and the key stroke. The horizontal portion 53*c* of the stop member is secured to the lower surface of the key 13 by a screw 55.

Figure 5:
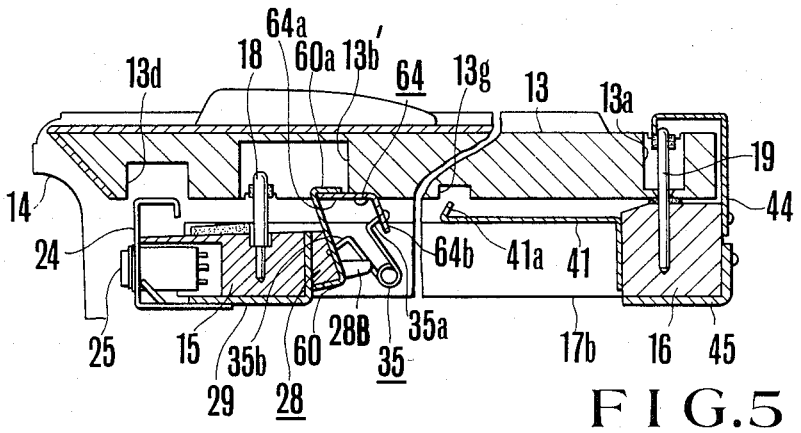
FIG. 5 is a sectional view, partially broken away, showing a third embodiment of the present invention.
Figure 6:
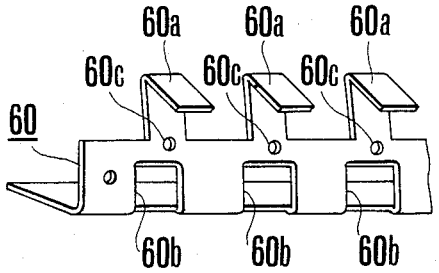
FIG. 6 is a perspective view showing the upper limit stopping member shown in FIG. 5.

FIG. 5 illustrates a third embodiment of the present invention, while FIG. 6 illustrates the upper limit stop member 60 for the third embodiment shown in FIG. 5. In this embodiment, the upper limit stop member 60 is secured to the stop block 28, shown in the first embodiment described above. The upper limit stop member 60 extends in the direction of an array of the juxtaposed keys 13 so that it can correspond to a plurality of the keys. Hook shaped upper limit stop members 60*a* corresponding to respective keys 13 are formed at the upper end of the upper limit stop member 60. These hook shaped upper limit stop members 60*a* are received in elongated recesses 13*b* formed in the lower surfaces of the keys 13. The upper limit stop member 60 is formed with rectangular apertures 60*b* corresponding to respective rearwardly directed projections 28B of the stop block 28 and small openings 60*c* for anchoring the other ends 35*b* of the key return springs 35 of respective keys 13.

A substantially L-shaped key return spring engaging member 64 is secured to the lower surface of each key 13. The forward end or horizontal portion 64*a* of the key return spring engaging member 64 extends into the opening of the recess 13*b* to engage the lower side of a horizontal bent portion of the hook shaped upper limit stop members 60*a*. The rearward end 64*b* is bent downwardly at an obtuse angle to form a spring engaging member adapted to engage one end 35*a* of the key return spring 35, as in the first embodiment. The key stroke can be adjusted by varying the bending angle of the horizontal bent portion of the hook shaped upper limit stop member 60*a* of the upper limit stop member 60.

Figure 7:
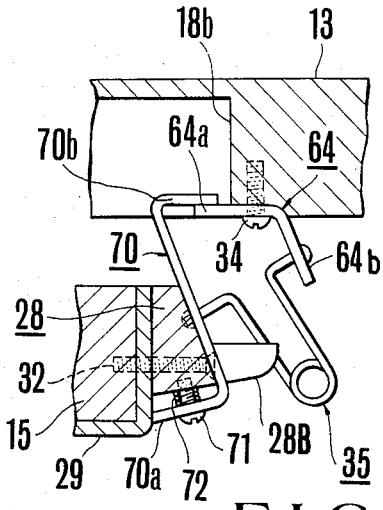
FIG. 7 is a side view showing a portion of the fourth embodiment of the present invention.
Figure 8:
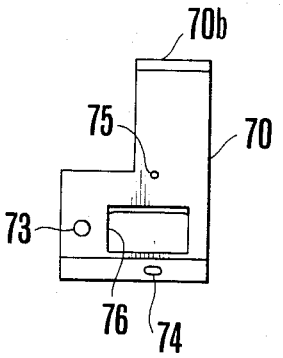
FIG. 8 is a rear side view of the upper limit stopping member shown in FIG. 7.

FIGS. 7 and 8 show a modification of the third embodiment. In this modification, the lower bent portion 70*a* of a substantially S-shaped upper limit stop member 70 is secured to the lower surface of the stop block 28 with a set screw 71 corresponding to each key 13. A spring 72 is interposed between the lower bent portion 70*a* and the stop block 28. With this construction, it is possible to adjust the upper limit stop member 70 in the vertical direction by rotating the set screw 71. Therefore, the key stroke can be adjusted without varying the bending angle of the engaging member 70*b* of the upper limit stop member 70, which engages the horizontal portion 64*a* of the key return spring engaging member 64 secured to the lower surface of the key 13 with a screw 34. As shown in FIG. 8, the upper limit stop member 70 is provided with openings 73 and 74 for inserting screws, a small opening 15 for anchoring one end of the key return spring 35, and a rectangular aperture 76 for receiving the projections 28B.

Figure 10A:
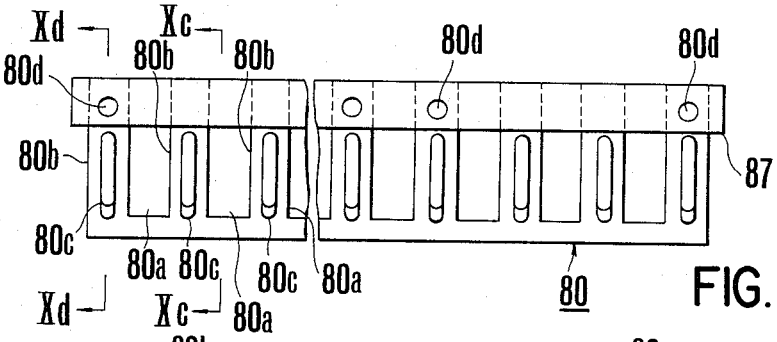
FIGS. 10(*a*) and 10(*b*) are a front view and a plan view, respectively, of the stop block shown in FIG. 9.
Figure 10B:
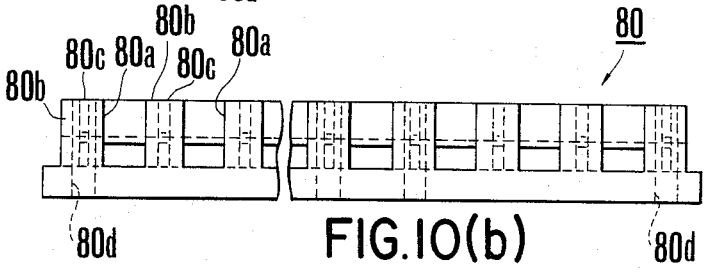
Figure 10C:
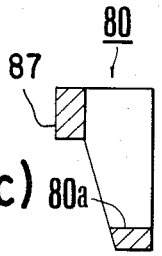
Figure 10D:
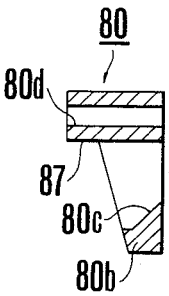

FIGS. 9 and 10*a* through 10*d* show a fourth embodiment of the present invention, wherein a stop block 80 is secured to the front surface of the front rail 15 with an L-shaped fitting 29'. The stop block 80, as best shown in FIGS. 10*a* and 10*b*, is made of a synthetic resin and has a sufficient length to correspond to a plurality of keys 13. The stop block 80 is provided with a plurality of stop member inserting openings 80*a* which are open in the lateral and vertical directions, partition walls 80*b* between the openings 80*a*, and a plurality of spring receiving openings 80*c*. The number of openings 80*a* corresponds to the number of keys 13. The stop block 80 is secured to the front rail 15 together with the L-shaped fitting 29' with set screws (not shown) passing through the screw mounting openings 80*d*.

Figure 9:
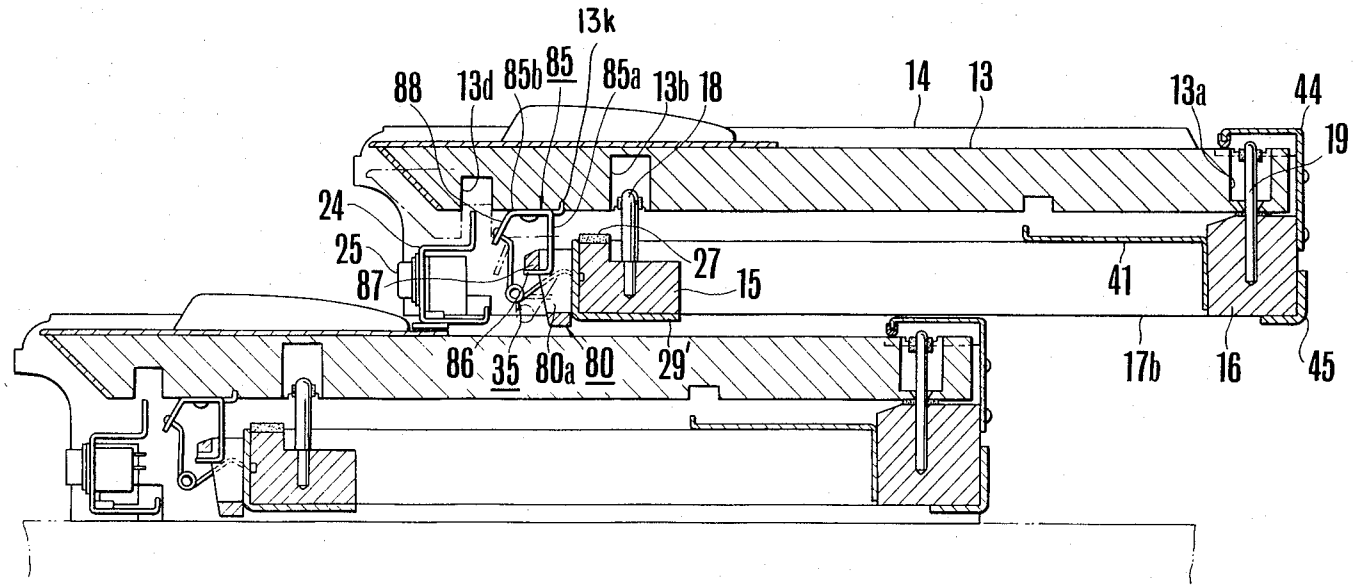
FIG. 9 is a longitudinal sectional view showing a fifth embodiment of the present invention.

A key return spring engaging member 85, as shown in FIG. 9, corresponding to the stop block 80, is secured to the lower surface of each key 13. Like the key return spring engaging member 33 shown in the first embodiment, the key return spring engaging member 85 includes a vertical portion 85*a* and a horizontal portion 85*b* formed integrally with the vertical portion 85*a* and extending in the horizontal direction along the length of the key 13. The vertical portion 85*a* is inserted from above into the stop member inserting opening 80*a* of the stop block 80 corresponding to each key 13, and the lower end 86 of the vertical portion 85*a* is bent forwardly at about ninety degrees (90°) to engage the lower surface of a projection 87 formed on the front surface of the stop block 80, thus forming the upper limit stop member. The forward end 88 of the horizontal portion 85*b* is bent downwardly at an obtuse angle to engage one end of the key return spring 35, thereby forming the key return spring engaging member 85. The rearward end of the horizontal portion 85*b* is bent upright to engage a slot 13K formed on the lower surface of the key 13. The other end of the key return spring 35 is inserted through a spring inserting opening 80*c*, corresponding to each key 13, to be anchored by the L-shaped fitting 29'. The key stroke and the key touch feeling are adjusted by varying the bending angles of the bent lower end portion 86 of the vertical portion 85*a* and the spring engaging member 85. Since the key return spring engaging member 85 is disposed on the front side of the front rail 15, when the front cover 24 for mounting the key switches is removed, the keys 13 can be readily adjusted without dismounting them from the keyboard frame 12.

As described above in the keyboard structure of the present invention for a musical instrument, since each key return spring and an upper limit stop member are closely disposed, the flexure of the keyboard frame is minimal so that it is possible to proportionally decrease the strength of the keyboard frame, as compared with prior art keyboard structures, thereby decreasing the manufacturing cost thereof. Moreover, the key stroke and the key touch feeling can be easily and rapidly adjusted. Moreover, by forming the upper limit stop member integrally with the key return engaging member which engages with one end of the key return spring, the number of the component parts can be reduced and thereby, the assembling of the keyboard assembly 100 is simplified. In addition, since the key return spring and the upper limit stop member are secured to the lower surface of each key near the forward end thereof, the aforementioned adjustments can be made more readily.

It will be appreciated by those skilled in the art that many variations and modifications may be made from the above detailed description, which is offered by way of example and not by way of limitation. Such variations and modifications are within the spirit of the present invention and the scope of the claims appended hereto.

What is claimed as novel is as follows:

1. A keyboard structure for an electronic musical instrument, said keyboard structure comprising:

a keyboard frame comprising a front rail, a back rail parallel to and spaced from said front rail, and means for interconnecting said front and back rails;

a plurality of keys juxtaposed said keyboard frame, each of said plurality of keys having a forward end portion extending across said front rail and a rearward end portion contiguous said back rail of said keyboard frame, said rearward end portion of each of said plurality of keys being pivotally interconnected with said back rail of said keyboard frame such that each of said plurality of keys is tiltable in a vertical direction about said pivotable interconnection;

a plurality of stop block members secured to said front rail such as to be located between said front and back rails, each of said plurality of stop block members further comprising a plurality of projections projecting in a first predetermined direction toward said back rail, said plurality of projections further being spaced along each of said plurality of stop block members in consecutive pairs, each of said pairs of said plurality of projections having a predetermined space therebetween;

a plurality of key return spring engaging members attached to said respective plurality of keys, each one of said plurality of key return spring engaging members being associated respectively with each one of said plurality of keys, each one of said plurality of key return spring engaging members having a subtending portion secured to said respectively associated each one of said plurality of keys, said subtending portion of each one of said plurality of key return spring engaging members further being spaced in close proximity to each of said pairs of said plurality of projections of each of said plurality of stop block members, each one of said plurality of key return spring engaging members further having a depending portion complementary with said subtending portion, said depending portion depending from said subtending portion secured to said respectively associated each one of said plurality of keys in a predetermined direction towards said plurality of stop block members;

said subtending portion of each one of said plurality of key return spring engaging members further having a forward end portion, an intermediate portion and a rearward end portion, said forward end portion being selectively formed along a plane normal to said intermediate portion to engage said respectively associated each one of said plurality of keys, said intermediate portion being secured to said respectively associated each one of said plurality of keys, said rearward end portion being pivotally attached to said intermediate portion at a selectively predetermined angular position;

said depending portion of each of said plurality of key return spring engaging members further having an adjustable pivotable end portion defining an upper limit stop member, said upper limit stop member intimately engaging each of said plurality of stop block members between consecutive pairs of said plurality of projections spaced along each of said plurality of stop block members; said upper limit stop member being adjustable pivotally to limit the vertical tilting motion of said respectively associated each one of said plurality of keys to selectively adjust the key stroke of said respectively associated each one of said plurality of keys; and a plurality of key return spring members, each of said plurality of key return spring members having one end interconnected with said rearward end portion of said subtending portion of each one of said plurality of key return spring engaging members; an opposite end attached neighboring a respective pair of each of said plurality of projections spaced along each of said plurality of stop block members; said opposite end of each of said plurality of key return spring members further extending into said predetermined space between each pair of projections of said plurality of projections for cooperation therewith; and an intermediate biasing portion between said one end and said opposite end, said intermediate biasing portion exerting a biasing force on said respectively associated each one of said plurality of keys to bias each of said plurality of keys away from said front rail whereby said one end of each of said key return spring members being interconnected with said rearward end portion of said subtending portion of each one of said plurality of key return spring engaging members and said adjustable pivotable end portion defining an upper limit stop member, of said depending portion of each of said plurality of key return spring engaging members being in close proximity to one another to permit quick and reliable adjustment for the key touch and key stroke for each of said plurality of keys.

2. The keyboard structure of claim 1 further comprising a plurality of key switches supported by said back rail of said keyboard frame at predetermined positions, each respective key switch of said plurality of key switches being associated with a respective key of said plurality of keys, each one of said respective plurality of key switches being selectively actuated in response to the vertical tilting of each one of said respective plurality of keys associated therewith in response to a downwardly directed force on the forward end portion of said respective key.

3. The keyboard structure of claim 1 wherein each of said plurality of stop block members interconnected with said front rail of said keyboard frame is provided with a first opening for receiving said opposite end of each of said plurality of key return spring members.

4. A keyboard structure for an electronic musical instrument, said keyboard structure comprising:

a keyboard frame comprising a forward end, a rearward end disposed opposite said forward end, a front rail at said forward end, a back rail parallel with said front rail and spaced away therefrom so as to be disposed at said rearward end of said keyboard frame, and interconnecting means for interconnecting said front rail with said back rail;

a plurality of keys juxtaposed said keyboard frame, each of said plurality of keys having a forward end portion extending across said front rail and a rearward end portion contiguous said back rail of said keyboard frame, said rearward end portion of each of said plurality of keys being pivotally interconnected with said back rail of said keyboard frame such that each of said plurality of keys is tiltable in the vertical direction about said pivotable interconnection, said forward end portion of each of said plurality of keys having a cavity formed therein, said cavity facing towards said keyboard frame;

a plurality of stop block members secured to said front rail such as to be located between said front and back rails, each of said plurality of stop block members further comprising a plurality of projections projecting in a first predetermined direction toward said back rail, said plurality of projections further being spaced along each of said plurality of stop block members in consecutive pairs, each of said pairs of said plurality of projections having a predetermined space therebetween;

a plurality of key return spring engaging members attached to said plurality of keys, each one of said plurality of key return spring engaging members being associated respectively with each one of said plurality of keys, each one of said plurality of key return spring engaging members having a subtending member secured to said respectively associated each one of said plurality of keys, said subtending member of each one of said plurality of key return spring engaging members having a forward end portion, an intermediate portion and a rearward end portion, said forward end portion extending a predetermined distance across said cavity formed in said forward end portion of each one of said plurality of keys, said intermediate portion being secured to said respectively associated each one of said plurality of keys, said rearward end portion being pivotally attached to said intermediate portion at a predetermined angular position; said subtending member of each one of said plurality of key return spring engaging members further being spaced in close proximity to said cavity and to each of said pairs of said plurality of projections of each of said plurality of stop block members for cooperation therewith;

each one of said plurality of key return spring engaging members further having a depending member secured to a respective one of each one of said plurality of stop block members, in a predetermined direction towards said subtending member for cooperation therewith; said depending member of each of said plurality of key return spring engaging members further having an adjustable pivotable end portion defining an upper limit stop member, said upper limit stop member intimately engaging said forward end of said subtending member to vary the vertical tilting motion of said respectively associated each one of said plurality of keys to selectively adjust the key stroke of said respectively associated each one of said plurality of keys; and a plurality of key return spring members, each of said plurality of key return spring members having one end interconnected with said rearward end portion of said subtending member of each one of said plurality of key return spring engaging members; an opposite end attached neighboring a respective pair of each of said plurality of projections spaced along each of said plurality of stop block members, said opposite end of each of said plurality of key return spring members further extending into said predetermined space between each pair of said plurality of projections for cooperation therewith; and an intermediate biasing portion between said one end and said opposite end, said biasing portion exerting a biasing force on said respectively associated each one of said plurality of keys to bias each of said plurality of keys away from said front rail whereby said one end of each of said key return spring members being interconnected with said rearward end portion of each of said subtending members of each one of said plurality of key return spring engaging members and said adjustable pivotable end portion defining an upper limit stop member of said depending member of each of said plurality of key return spring engaging members being in close proximity to one another permits quick and reliable adjustment for the key touch and key stroke for each of said plurality of keys.

5. The keyboard structure of claim 4 further comprising a plurality of key switches supported by said back rail of said keyboard frame at predetermined positions, each respective key switch of said plurality of key switches being associated with a respective key of said plurality of keys, each one of said respective plurality of key switches being selectively actuated in response to the vertical tilting of each one of said respective plurality of keys associated therewith in response to a downwardly directed force on the forward end portion of said respective key.

6. The keyboard structure of claim 4 wherein each of said plurality of stop block members interconnected with said front rail of said keyboard frame is provided with a first opening for receiving said opposite end of each of said plurality of key return spring members.

7. The keyboard structure of claim 4 wherein said depending member further comprises means for resiliently adjusting said depending member with respect to each one of said plurality of stop block members.

8. A keyboard structure for an electronic musical instrument, said keyboard structure comprising:

a keyboard frame comprising a front rail, a back rail parallel to and spaced from said front rail, and means for interconnecting said front and back rails;

a plurality of keys juxtaposed said keyboard frame, each of said plurality of keys having a forward end portion extending across said front rail and a rearward end portion contiguous said back rail of said keyboard frame, said rearward end portion of each of said plurality of keys being pivotally interconnected with said back rail of said keyboard frame such that each of said plurality of keys is tiltable in a vertical direction about said pivotable interconnection;

a plurality of stop block members secured to said front rail, each of said plurality of stop block members further comprising a plurality of partitions projecting in a first predetermined direction away from said front and back rails, said plurality of partitions further being spaced along each of said plurality of stop block members in consecutive pairs with a projection portion arranged between said consecutive pairs of partitions, each of said pairs of said partitions further having a predetermined space therebetween;

a plurality of key return spring engaging members attached to said respective plurality of keys, each one of said plurality of key return spring engaging members being associated respectively with each one of said plurality of keys, each one of said plurality of key return spring engaging members having a subtending portion secured to said respectively associated each one of said plurality of keys, said subtending portion of each one of said plurality of key return spring engaging members further being spaced in close proximity to each of said pairs of said plurality of partitions of each of said plurality of stop block members, each one of said plurality of key return spring engaging members further having a depending portion complementary with said subtending portion, said depending portion depending from said subtending portion secured to said respectively associated each one of said plurality of keys in a predetermined direction towards said projection portion between said consecutive pairs of partitions of each of said plurality of stop block members;

said subtending portion of each one of said plurality of key return spring engaging members further having a forward end portion, an intermediate portion and a rearward end portion, said rearward end portion being selectively formed along a plane normal to said intermediate portion to engage said respectively associated each one of said plurality of keys, said intermediate portion being secured to a lower surface of said respectively associated each one of said plurality of keys, said forward end portion being pivotally attached to said intermediate portion at a selectively predetermined angular position;

said depending portion of each of said plurality of key return spring engaging members further having an adjustable pivotable end portion, defining an upper limit stop member, said upper limit stop member intimately engaging said projection portion of each respective one of said plurality of stop block members between consecutive pairs of said plurality of partitions spaced along each of said plurality of stop block members, said upper limit stop member being adjustable pivotally to limit the vertical tilting motion of said respectively associated each one of said plurality of keys to selectively adjust the key stroke of said respectively associated each one of said plurality of keys; and a plurality of key return spring members, each of said plurality of key return spring members having one end interconnected with said forward end portion of said subtending portion of each one of said plurality of key return spring engaging members; an opposite end attached neighboring a respective pair of each of said plurality of partitions spaced along each of said plurality of stop block members, said opposite end of each of said plurality of key return spring members further extending into said predetermined space between each pair of partitions of said plurality of partitions for cooperation therewith, said opposite end further mounted to said respective one of each of said plurality of stop block members; and an intermediate biasing portion between said one end and said opposite end, said intermediate biasing portion exerting a biasing force on said respectively associated each one of said plurality of keys to bias each of said plurality of keys away from said front rail, whereby said one end of each of said key return spring members being interconnected with said forward end portion of said subtending portion of each one of said plurality of key return spring engaging members and said adjustable pivotable end portion defining an upper limit stop member of said depending portion of each of said plurality of key return spring engaging members being in close proximity to one another to permit quick and reliable adjustment for the key touch and key stroke for each of said plurality of keys.

9. The keyboard structure of claim 8 further comprising a plurality of key switches supported by said back rail of said keyboard frame at predetermined positions, each respective key switch of said plurality of key switches being associated with a respective key of said plurality of keys, each one of said respective plurality of key switches being selectively acutated in response to the vertical tilting of each one of said respective plurality of keys associated therewith in response to a downwardly directed force on the forward end portion of said respective key.

10. The keyboard structure of claim 8 wherein each of said plurality of stop block members interconnected with said front rail of said keyboard frame is provided with a first opening for receiving said opposite end of each of said plurality of key return spring members.

11. A keyboard structure for an electronic musical instrument, said keyboard structure comprising:

a keyboard frame comprising a front rail, a back rail parallel to and spaced from said front rail, and means for interconnecting said front and back rails;

a plurality of keys juxtaposed said keyboard frame, each of said plurality of keys having a forward end portion extending across said front rail and a rearward end portion contiguous said back rail of said keyboard frame, said rearward end portion of each of said plurality of keys being pivotally interconnected with said back rail of said keyboard frame such that each of said plurality of keys is tiltable in a vertical direction about said pivotable interconnection, said forward end portion of each of said plurality of keys having a cavity formed therein, said cavity facing towards said keyboard;

at least one key return spring engaging member attached to said front rail of said keyboard frame, said at least one key return spring engaging member comprising at least one projection extending in a first predetermined direction towards said back rail, said projection further terminating in an upright pin portion extending in a direction towards said cavity of each one of said plurality of keys;

at least one spring member having one end mounted in said cavity of each one of said plurality of keys, said at least one spring member further having an opposite end engaging said at least one projection of said at least one key return spring engaging member and further surrounding said upright pin portion extending in said direction towards said cavity of each one of said plurality of keys for communication therewith;

a plurality of upper limit stop members attached to said plurality of keys, each one of said plurality of upper limit stop members being associated respectively with each one of said plurality of keys, each one of said plurality of upper limit stop members having a subtending portion secured to said respectively associated each one of said plurality of keys, said subtending portion of each one of said plurality of upper limit stop members further being spaced in close proximity to said cavity of each respective one of said plurality of keys, each one of said plurality of upper limit stop members further having a depending portion complementary with said subtending portion;

said depending portion depending from said subtending portion secured to said respectively associated each one of said plurality of keys in a predetermined direction towards said at least one projection of said at least one key return spring engaging members;

said subtending portion of each one of said plurality of key return spring engaging members further having a forward end portion, an intermediate portion and a rearward end portion, said forward end portion being selectively formed along a plane normal to said intermediate portion to engage said respectively associated each one of said plurality of keys proximate said cavity therein, said rearward end portion being secured to said respectively associated each one of said plurality of keys, said intermediate portion extending along each one of said plurality of keys and further being integrally formed with said depending portion;

said dependent portion of each of said plurality of upper limit stop members further having an adjustable pivotable end portion defining an upper limit stop end portion, said upper limit stop end portion intimately engaging said at least one projection extending from said at least one key return spring engaging member, said upper limit stop end portion being adjustable pivotally to limit the vertical tilting motion of said respectively associated each one of said plurality of keys to simultaneously adjust the key touch and key stroke of said respectively associated each one of said plurality of keys; and whereby said at least one projection of said at least one said key return spring engaging member and said adjustable pivotable end portion defining an upper limit stop end portion of said depending portion of each of said plurality of upper limit stop members being in close proximity to one another permits quick and reliable simultaneous adjustment for the key touch and key stroke for each of said plurality of keys.

12. The keyboard structure of claim 11 wherein said at least one spring member comprises a compression spring interposed between a lower surface of each one of said respective keys and said at least one projection of said at least one key return spring engaging member.

13. The keyboard structure of claim 11 wherein each one of said key return spring engaging members comprises an L-shaped member secured to said front rail of said keyboard frame.

14. The keyboard structure of claim 11 further comprising a plurality of key switches supported by said back rail of said keyboard frame at predetermined positions, each respective key switch of said plurality of key switches being associated with a respective key of said plurality of keys, each one of said respective plurality of key switches being selectively actuated in response to the vertical tilting of each one of said respective plurality of keys associated therewith in response to a downwardly directed force on the forward end portion of said respective key.

* * * * *

UNITED STATES PATENT AND TRADEMARK OFFICE

CERTIFICATE OF CORRECTION

PATENT NO. : 4,510,839

DATED : April 16, 1985

INVENTOR(S) : Shinji Kumano

It is certified that error appears in the above-identified patent and that said Letters Patent is hereby corrected as shown below:

Column 4, line 4, delete "vertical plate" and insert ---- vertical piece ----.

Column 5, line 34, delete "end 52c" and insert ---- end 52a ----.

Column 6, line 22, delete "opening 15" and insert ---- opening 75 ----.

In The Claims

Column 12, line 40, delete "acutated in" and insert ---- acuated in ----.

Signed and Sealed this

*Twelfth* Day of *November 1985*

[SEAL]

*Attest:*

*Attesting Officer*

DONALD J. QUIGG

*Commissioner of Patents and Trademarks*